US005253789A

United States Patent [19]

Mateko

[11] Patent Number: 5,253,789

[45] Date of Patent: Oct. 19, 1993

[54] FUEL PELLET BUCKET CONSTRUCTION

[76] Inventor: Nicholas S. Mateko, 36079 Brandywine St., Newark, Calif. 94560

[21] Appl. No.: 903,116

[22] Filed: Jun. 23, 1992

[51] Int. Cl.[5] ..... B67C 11/00

[52] U.S. Cl. ..... 222/462; 222/466; 222/556

[58] Field of Search ..... 222/462, 466, 482, 556, 222/535, 531, 572; 220/2, 773, 774; 232/43.1

[56] References Cited

U.S. PATENT DOCUMENTS

| | | | |
|---|---|---|---|
| D. 25,419 | 4/1896 | Gorris | D23/410 |
| D. 120,685 | 5/1940 | Kimler | D23/410 |
| D. 209,360 | 11/1967 | Carr | D23/410 |
| D. 261,604 | 11/1981 | Wright | D23/410 |
| 362,616 | 5/1887 | Freubenberg | 220/2 |
| 1,056,572 | 3/1913 | Nadeau | 220/2 |
| 1,362,186 | 12/1920 | Price | 222/462 |
| 1,499,902 | 7/1924 | Bardera | 222/556 |
| 1,853,481 | 4/1932 | Whitney | 222/462 |
| 2,939,617 | 6/1960 | Hassler | 222/556 |
| 3,368,721 | 2/1968 | Wiskochil | 222/466 |

FOREIGN PATENT DOCUMENTS

| | | | |
|---|---|---|---|
| 17195 | of 1904 | United Kingdom | 222/466 |
| 2184101 | 6/1987 | United Kingdom | 222/556 |

*Primary Examiner*—Andres Kashnikow
*Assistant Examiner*—Philippe Derakshani
*Attorney, Agent, or Firm*—Henderson & Sturm

[57] ABSTRACT

A pellet bucket construction (10) including: a receptacle member (20) provided with a pair of pivoted handle members (40) and (41); and, a nozzle member (30) having a nozzle opening (35) controlled by a hinged closure flap (60) and a feed opening (36) controlled by a feed chute member (50) which allows fuel pellets to be introduced into both the receptacle member (20) and the nozzle member (30).

3 Claims, 2 Drawing Sheets

FUEL PELLET BUCKET CONSTRUCTION

TECHNICAL FIELD

The present invention relates to the field of scuttle or hopper devices in general, and in particular to a dual handle dispensing bucket construction having a novel receptacle refilling arrangement.

BACKGROUND ART

This invention was the subject matter of Document Disclosure Program Registration No. 298,052 which was filed in the United States Patent and Trademark Office on Dec. 23, 1991.

As can be seen by reference to the following U.S. Pat. Nos. D25,419; D261,604; D209,360; and D120,685; the prior art is replete with myriad and diverse scuttle constructions for transporting, storing and dispensing items such as coal for wood pellets for use in wood burning stoves.

While all of the aforementioned prior art constructions are more than adequate for the basic purpose and function for which they have been specifically designed, these patented devices have been uniformly deficient in that they only utilize a single pivoted handle for transporting and handling the scuttle.

In addition, none of the aforementioned prior art constructions employ a feeder chute in conjunction with the spout or nozzle portion of the scuttle to allow the interior of the scuttle to be replenished.

As a consequence of the foregoing situation, there has existed a longstanding need particularly among owners of wood burning stoves, for a new type of scuttle construction that avoids all of the shortcomings of the prior art, in a simple and efficient manner; and, the provision of such a construction is a stated objective of the present invention.

DISCLOSURE OF THE INVENTION

Briefly stated, the pellet bucket construction that forms the basis of the present invention comprises a receptacle unit having a nozzle unit angled outwardly with respect to the receptacle unit. In addition the receptacle unit is provided with a dual pivoted handle arrangement; and the nozzle unit is further provided with a closure unit and feed chute unit for refilling the receptacle.

As will be explained in grater detail further on in the specification, the pellet bucket construction of this invention simplifies the task of transporting and handling of the scuttle both to, and from the point of use; as well as simplifying the task of refilling the receptacle unit via a new type of feed chute unit built into the nozzle unit which prevents the pellets being introduced through the feed chute unit from spilling on the ground or floor.

In addition the placement of the feed chute unit in the nozzle unit substantially increases the load capacity of the construction beyond the capacity of the receptacle unit per se.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
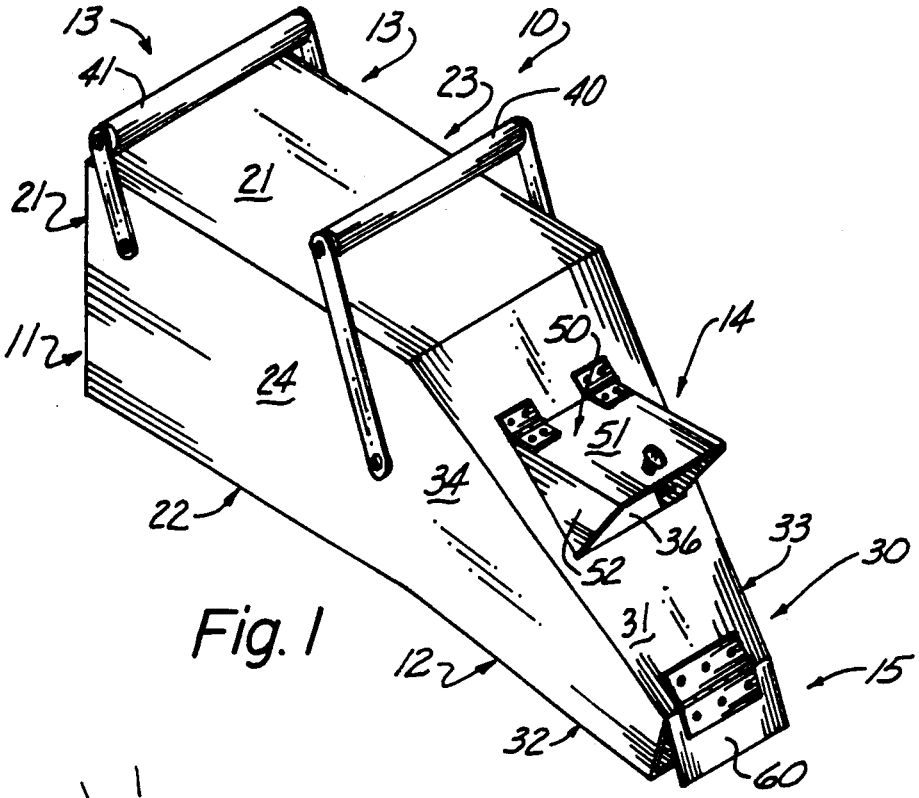
FIG. 1 is a perspective view of the pellet bucket construction that forms the basis of the present invention.

As can be seen by reference to the drawings, and in particular to FIG. 1. the pellet bucket construction that forms the basis of the present invention is designated generally by the reference numeral (10). The construction (10) comprises in general a receptacle unit (11) a nozzle unit (12) a handle arrangement (13); a filler chute unit (14); and, a nozzle closure unit (15). These units will now be described in seriatim fashion.

Figure 2:
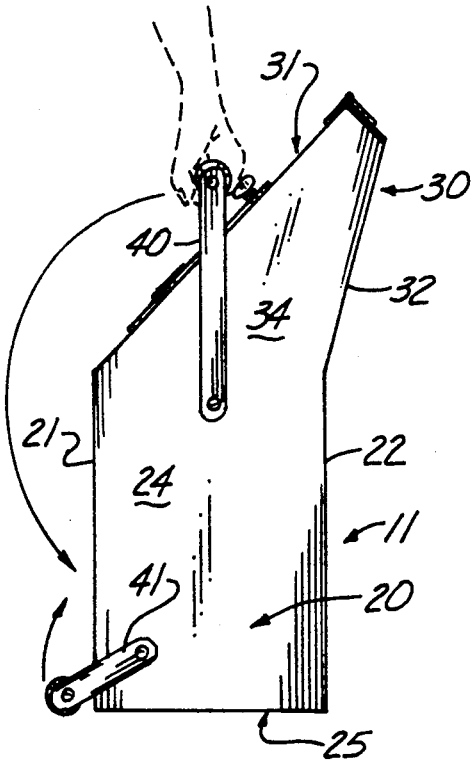
FIG. 2 is a side elevation view of the construction in the storage mode.

As shown in FIGS. 1 and 2, the receptacle unit (11) comprises a generally rectangular open ended receptacle member (20) having front (21) rear (22) two side (23) (24) and a closed bottom panel (25). In addition, the nozzle unit (12) comprises a four sided nozzle member (30); wherein, each of the sides defines a tapered trapezoidal configuration.

Figure 6:
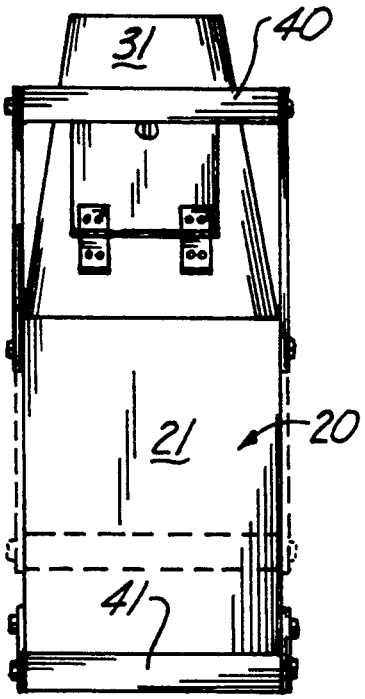
FIG. 6 is a rear plan view of the construction in the storage mode.

As can be seen by reference to FIGS. 1, 2 and 6, the nozzle member (30) comprises a front panel (31) back panel (32) and two side panels (33) (34) which extend upwardly and outwardly from the corresponding panels (21) (22) (23) and (24) of the receptacle member (20); wherein, the front panel (31) is inclined at a more acute angle relative to the vertical axis than the rear panel (32).

Figure 4:
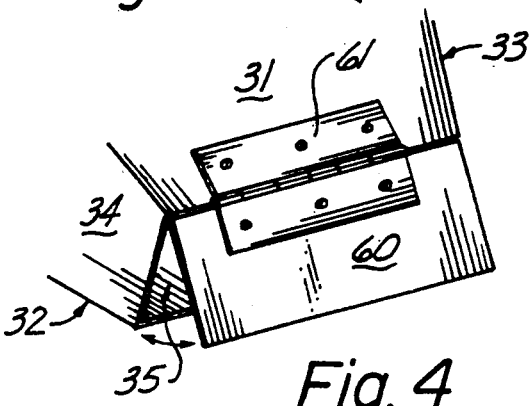
FIG. 4 is an isolated perspective view of the dispenser flap.
Figure 5:
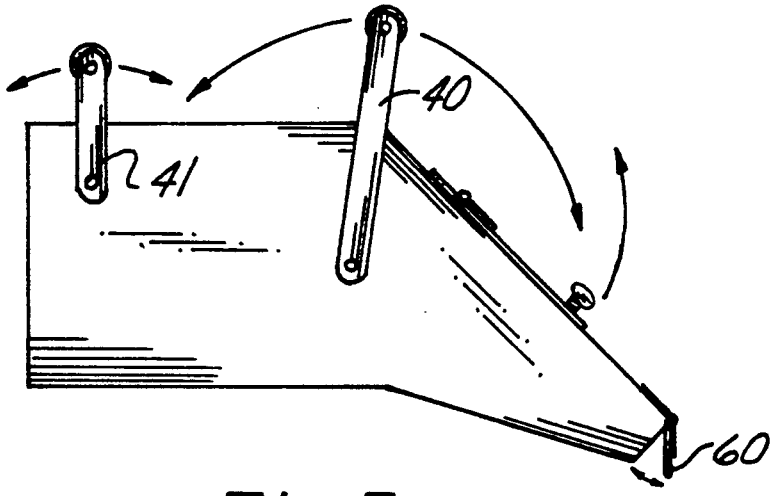
FIG. 5 is a side elevation view of the construction in the dispensing mode.

In addition as can best be seen by reference to FIGS. 2 and 4, the outboard ends of the front (31), rear (32) and side (33) (34) terminate in a generally rectangular nozzle opening (35) which is aligned in a plane generally perpendicular to the angular orientation of the front panel (31).

As shown in FIGS. 1, 2, 5 and 6, the handle arrangement (13) comprises an upper generally elongated pivoted handle member (40) and a lower relatively short pivoted handle member (41); wherein, the upper elongated handle member (40) is pivotally attached proximate to, but spaced from, the top of the side panels (23) (24) of the receptacle member (20) at a point midway between the front (21) and rear (22) panels. In addition, the length of the upper handle member (40) is chosen such that the upper handle member (40) may be pivoted to the vertical position as illustrated in FIG. 2, while still allowing for clearance between the users hand and the angled front panel (31) of the nozzle member (30).

Still referring to FIG. 2; it can be seen that the lower handle member (41) is pivotally attached to the side panels (23) (24) of the receptacle member (20) at a point offset from the longitudinal axis of the receptacle member (20) and proximate to, but spaced from the front panel (21), wherein the pivoted connection is located approximately equidistant from the front panel (21) and the bottom panel (25).

Figure 3:
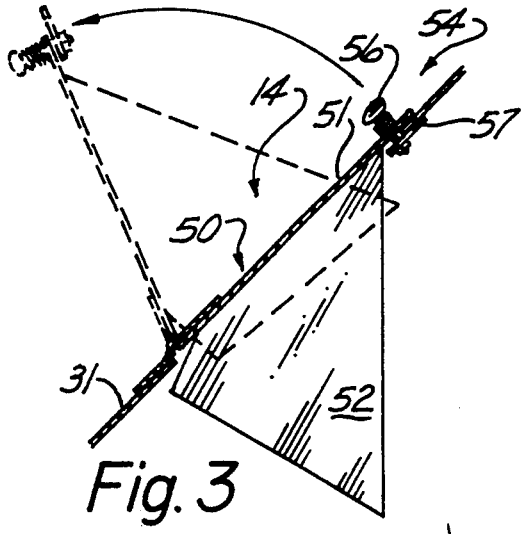
FIG. 3 is a detailed cross-sectional view of the filler chute with one type of closure mechanism.
Figure 7:
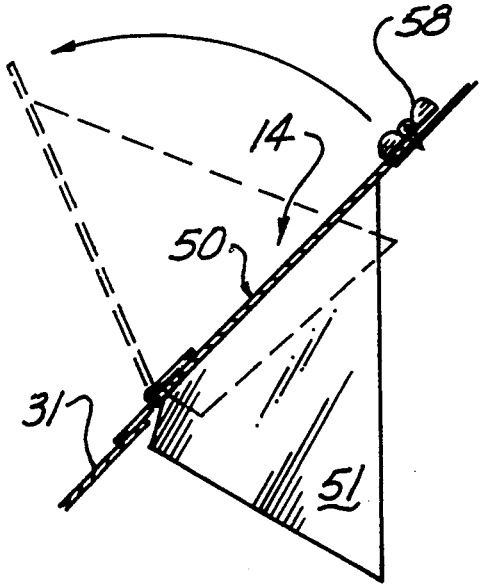
FIG. 7 is a detailed cross-sectional view of the filler chute with another type of closure mechanism.

Turning now to FIGS. 1, 3, and 7 it can be seen that the filter chute unit (14) comprises in general a chute member (50) including a cover plate element (51) hingedly connected to the front panel (31) of the nozzle member (30) and dimensioned to overlie a generally rectangular feed opening (36) formed in the nozzle member (30). In addition each side of the cover plate element (51) is provided with an inwardly projecting generally triangular flange element (52) which extends inwardly into the interior of the nozzle member (30); wherein the cover plate elements (51) and flanges (52) form a large mouthed feed chute for depositing fuel pellets through the nozzle member (30) and into the receptacle member (20).

As shown in FIGS. 3 and 7, the chute member (50) may be provided with different types of locking mechanisms designated generally as (54) and (55) for operatively securing the cover plate element (51) to the front panel (31) of the nozzle member (30).

In the embodiment depicted in FIG. 3, the locking mechanism (54) comprises a spring loaded knob stem (56) which projects through the cover plate element (51) and is provided on its lower end with a locking tab (57); wherein, the rotation of the knob stem (56) will bring the locking tab (57) into and out of engagement with the underside of the front panel (31) of the nozzle member (30).

In the embodiment depicted in FIG. 7, the locking mechanism (55) comprises a wing nut (58) rotatably mounted on the front panel (31) of the nozzle member (30) proximate the cover plate member (51), such that one of the arms of the wing nut (58) may be brought into an overlapping engagement with the cover plate element (51).

Turning now to FIG. 4, it can be seen that the nozzle closure unit (15) comprises a generally rectangular nozzle closure flap (60) hingedly connected as at (61) to the upper end of the front panel (31); wherein, the closure flap (60) is dimensioned to overlie the generally rectangular nozzle opening (35).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A pellet bucket construction consisting of:

an open ended receptacle member having a bottom panel;

a tapered nozzle member disposed at an inclined angle, and operatively attached to, the top of the receptacle member; wherein the nozzle member is provided with a downwardly inclined nozzle opening one end and a feed opening disposed on an inclined upper surface, and a hinged closure flap which is dimensioned to overlie the nozzle opening; and wherein, at least a portion of the outboard end of the nozzle member extends outwardly relative to one side of the receptacle member; and, a feed chute member, including cover plate element hingedly connected to the upper surface of the nozzle member and dimensioned to overlie the feed opening, wherein each of the sides of the cover plate element are provided with inwardly extending flange elements which projects into the interior of the nozzle member.

2. The pellet bucket construction as in claim 1; further comprising;

locking means for releasably securing the cover plate element over the feed opening int eh nozzle member.

3. The pellet bucket construction as in claim 1; wherein, the receptacle member is further provided with a pair of pivoted handle members.

* * * * *